US009131771B2

(12) United States Patent
Lindblom

(10) Patent No.: US 9,131,771 B2
(45) Date of Patent: Sep. 15, 2015

(54) SLIDING DRAWER ASSEMBLY FOR USE WITH GONDOLA SHELVING SYSTEMS

(71) Applicant: Streater LLC, Albert Lea, MN (US)

(72) Inventor: Thomas G. Lindblom, Claremont, MN (US)

(73) Assignee: Streater LLC, Albert Lea, MN (US)

( * ) Notice: Subject to any disclaimer, the term of this patent is extended or adjusted under 35 U.S.C. 154(b) by 0 days.

(21) Appl. No.: 14/027,962

(22) Filed: Sep. 16, 2013

(65) Prior Publication Data

US 2015/0076983 A1 Mar. 19, 2015

(51) Int. Cl.
*A47B 88/04* (2006.01)
*A47B 96/02* (2006.01)

(52) U.S. Cl.
CPC ..... *A47B 88/0455* (2013.01); *A47B 88/0418* (2013.01); *A47B 96/028* (2013.01)

(58) Field of Classification Search
CPC ..... A47F 3/004; A47F 3/06; A47F 5/0018; A47F 5/0043; A47F 5/0081; A47F 5/10; A47F 5/108; A47F 5/11; A47B 88/0455; A47B 88/0418; A47B 88/0422; A47B 88/0429
USPC ..... 312/117, 122, 126, 128, 280, 281, 308, 312/309, 312, 330.1, 334.1, 334.7, 334.8, 312/348.4; 211/187, 103, 190, 207, 151, 211/126.15, 90.01
See application file for complete search history.

(56) References Cited

U.S. PATENT DOCUMENTS

| | | | | | |
|---|---|---|---|---|---|
| 5,611,442 | A * | 3/1997 | Howard | 211/187 |
| 5,673,801 | A * | 10/1997 | Markson | 211/59.3 |
| 5,720,230 | A * | 2/1998 | Mansfield | 108/108 |
| 5,797,503 | A * | 8/1998 | Stevens et al. | 211/187 |
| 5,924,367 | A * | 7/1999 | Henke et al. | 108/108 |
| 6,164,462 | A * | 12/2000 | Mumford | 211/59.2 |
| 6,234,328 | B1 * | 5/2001 | Mason | 211/90.02 |
| 6,273,534 | B1 * | 8/2001 | Bueley et al. | 312/334.8 |
| 6,497,185 | B1 * | 12/2002 | Barrett et al. | 108/108 |
| 6,527,122 | B1 * | 3/2003 | Taylor et al. | 206/509 |
| 7,311,211 | B2 * | 12/2007 | Chung | 211/90.02 |
| 8,210,363 | B2 * | 7/2012 | Hardy | 211/59.3 |
| 2012/0055892 | A1 * | 3/2012 | Hardy | 211/59.3 |

FOREIGN PATENT DOCUMENTS

| | | | | |
|---|---|---|---|---|
| FR | 2688665 | A1 * | 9/1993 | A47F 5/00 |
| JP | H05317142 | A * | 12/1993 | A47F 3/04 |

* cited by examiner

*Primary Examiner* — Daniel J Troy
*Assistant Examiner* — Andrew Roersma
(74) *Attorney, Agent, or Firm* — Nikolai & Mersereau, P.A

(57) ABSTRACT

A sliding drawer is coupled to a gondola-style shelving unit by providing mounting brackets and telescoping brackets which are used to couple the drawer to the shelf of a gondola-style shelving unit. Alternatively, the shelf may be eliminated by mounting brackets with the hooks typically found at opposite sides of a gondola-style shelf. Whether the shelf is employed or the hooks are provided on the mounting brackets, the hooks mate with slots in the upright vertical posts of the frame of the gondola-style shelving unit to mount the drawer to the frame.

10 Claims, 7 Drawing Sheets

SLIDING DRAWER ASSEMBLY FOR USE WITH GONDOLA SHELVING SYSTEMS

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates to gondola-style shelving systems. More particularly, this invention relates to sliding drawers adapted for use with gondola-style shelving systems.

II. Related Art

Gondola-style shelving systems are used in a variety of retail stores including hardware stores, pharmacies, convenience stores, grocery stores and big box department stores. One advantage of gondola-style shelving is it provides an effective, low-cost product display. Another advantage is that gondola-style shelving systems are readily customizable to meet the space requirements of retail outlets.

Gondola-style shelving systems are freestanding and are typically manufactured with heavy duty steel components. Such shelving systems typically include a frame comprising a base and back assembly. The back assembly includes a plurality of vertical support posts spaced a fixed distance from each other. The space between the posts may be left open or filled with pegboard or a solid surface material. The posts support the shelves of the shelving system. The pegboard or solid surface material prevents items from being pushed off the back of the shelves of the shelving system.

Most stores use three different types of gondola units as part of a gondola-style shelving system—center units, wall units and end units. The posts of the center units are often hollow and include a plurality of spaced slots extending through front and back walls of the posts. The shelves are provided with brackets having hooks which mate with selected slots on either the front or back wall of adjacent posts to couple the shelves to the posts. Shelves can extend in opposite directions from the posts given the arrangement of slots on opposite sides (walls) of the posts.

The wall units of a gondola-style shelving system are intended to sit against the wall of a room. The posts of the wall units need only have slots on one side (or wall) because the shelves only project from one side, i.e., away from the posts and away from the wall of the room. The opposite sides (or walls) of the posts reside in face-to-face registration with the wall of the room and typically sit tight against a wall of the room. The end units of a gondola-style shelving system also have shelves projecting from one side of the posts of the frame. End units are designed to be placed at the end of a row of center units or wall units so that the shelves of the end unit extend away from and run perpendicular to the shelves of the center or wall units making up the row.

Typically the shelving units include a plurality of shelves supported by the adjacent posts of the back members of the frame in a spaced, vertical arrangement. The distance between shelves and the height of any particular shelf can be adjusted by selecting from the plurality of slots in the posts and coupling the shelf brackets to the selected slots.

Standard shelves used in gondola-type shelving systems are typically provides with rows of perforations running along the front and back of the shelf and extending through the shelf. These rows of perforations are arranged (and the individual perforations are sized) to receive support rods of fencing and dividers. Such shelves will typically support up to about 500 pounds. Such shelves are typically open so that items on the shelf can be directly viewed.

Standard gondola-style shelving systems have certain disadvantages when employed in a retail environment. One such disadvantage is it is generally not possible to hide items placed on the shelf from view. Also, the risk of shoplifting in a retail environment increases because items placed on the shelf are readily accessible by customers and the design of the shelving offers opportunities for thieves to conceal their activities from view. Such shelving units typically do not provide a means for securing expensive items. Also, the shelves of a gondola-style shelving system are generally flat. Items which tend to roll on flat surfaces are not easily stored because they might roll off the shelf unless the aforementioned fences or dividers are employed.

Finally, the shelves of a standard gondola-style shelving system are fixed to the vertical posts of the frame. As such, they do not telescope or slide with respect to the vertical support posts of the frame or other shelves. Also, the shelves are typically arranged one above the other such that it is not possible to view the entire contents of all but the top shelf without removing the contents from the shelf. A need therefore exists for a sliding, lockable drawer attachable to the support posts of a gondola-style shelving system which enables items contained therein to be viewed and which can secure merchandise better than standard shelves commonly used with a gondola-style shelving unit.

SUMMARY OF THE INVENTION

The present invention provides a drawer assembly used in conjunction with the frames of gondola-style shelving units. In one embodiment, the drawer assembly comprises a standard gondola-style shelf having end brackets on the shelf which permit the shelf to be attached to adjacent posts of back members of the frame of the shelving unit, a pair of mounting brackets, a pair of telescoping brackets, and a drawer.

The drawer has a bottom wall, a front wall, first and second side walls and a back wall. A separate mounting bracket is joined to the shelf adjacent each of the first and second sides of the drawer. More specifically, the mounting brackets are L-shaped and have a first leg joined to the shelf using fasteners which pass through holes in the first leg of the L-shaped bracket and through front and back perforations of the shelf. The mounting brackets have a second leg which projects from the first leg away from the shelf at a right angle. Secured to the second leg of each of the L-shaped mounting brackets is the telescoping bracket. Each of the telescoping brackets has a first member which slides in and out with respect to a second member. The first member of each telescoping bracket is attached by fasteners so that it is fixed to the second leg of one of the L-shaped mounting brackets. The second member of each telescoping member is coupled to a side of the drawer. As such, the drawer is fastened to the shelf and can slide between a first closed position wherein the bottom of the drawer is in face-to-face registration with the top of the shelf and an open position in which the drawer is extended outwardly from the front of the shelf. To provide increased travel distance for the drawer, the telescoping bracket may include one or more intermediate members positioned between the first and second members.

The drawer assembly may also include a lock for securing the drawer in the closed position. The drawer may be made entirely of opaque materials. Alternatively, the front of the drawer may be made of, or include, a transparent panel made of glass, Plexiglas, or some other suitable transparent material such that the contents of the drawer can be viewed even when the drawer is closed. Also, the use of a shelf to support the drawer may be eliminated if hooks, like those of the end bracket of the shelf, are formed integrally with or joined to the L-shaped mounting bracket. In such case, the L-shaped mounting brackets are attached to the posts of the frame via such hooks mating with the holes or slots of the adjacent post.

The foregoing assembly provides an easy-to-install drawer assembly for use with a gondola-style shelving system. One or more such drawer assemblies may be employed and arranged adjacent to each other either horizontally, vertically, or both horizontally and vertically as desired.

BRIEF DESCRIPTION OF THE DRAWINGS

The foregoing features, objects and advantages of the invention will become apparent to those skilled in the art from the following detailed description and with reference to the following drawings in which like numerals and the several views refer to corresponding parts.

DETAILED DESCRIPTION

Figure 1:
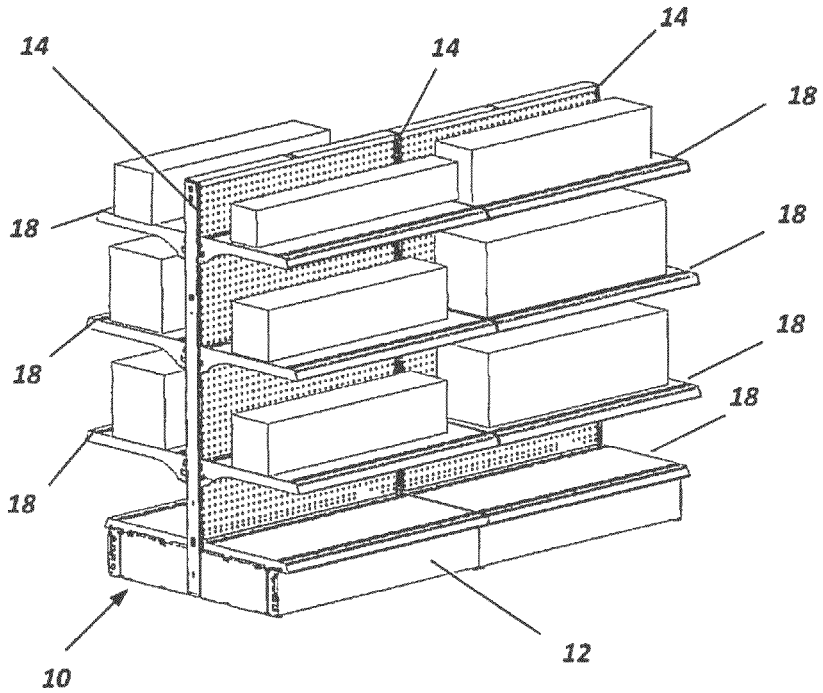
FIG. 1 is a perspective view of a center unit of gondola-style shelving.

This description of the preferred embodiment is intended to be read in connection with the accompanying drawings, which are to be considered part of the entire written description of this invention. In the description, relative terms such as "lower", "upper", "horizontal", "vertical", "above", "below", "up", "down", "top" and "bottom", as well as derivative thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Further, terms such as "connected", "connecting", "attached", "attaching", "joined", and "joining" are used interchangeably and refer to one structure or surface being secured to another structure or surface or integrally fabricated in one piece, unless expressly described otherwise.

Shelving units and drawer systems which can be installed on shelving units are shown in the drawings. More specifically, FIGS. 1-5 are illustrative of standard gondola-type shelving units currently available. FIGS. 6-16 are illustrative of novel drawer arrangements which can be used with a standard gondola-style shelving system.

Figure 2:
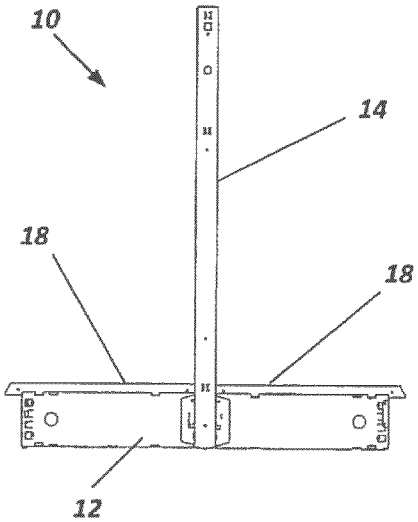
FIG. 2 is an end view of the frame (with the shelves removed) of the center unit of gondola-style shelving of FIG. 1.
Figure 3:
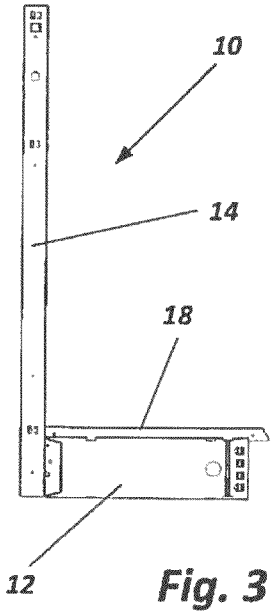
FIG. 3 is an end view of the frame of an end unit or wall unit of gondola-style shelving.

As illustrated by FIGS. 2 and 3, gondola-style shelving systems includes shelving units which are intended to sit against a wall (as shown in FIG. 3) or sit away from a wall as shown in FIGS. 1 and 2. Whether the gondola-style shelving unit is intended to be located in the center of a room or against a wall, the gondola-style shelving system includes a frame 10 comprising a base 12 and upright vertical posts 14. The base 12 supports the vertical post 14 in an upright position and, as illustrated in FIG. 1, the shelves 18 are attached to the upright vertical posts 14.

Figure 4:
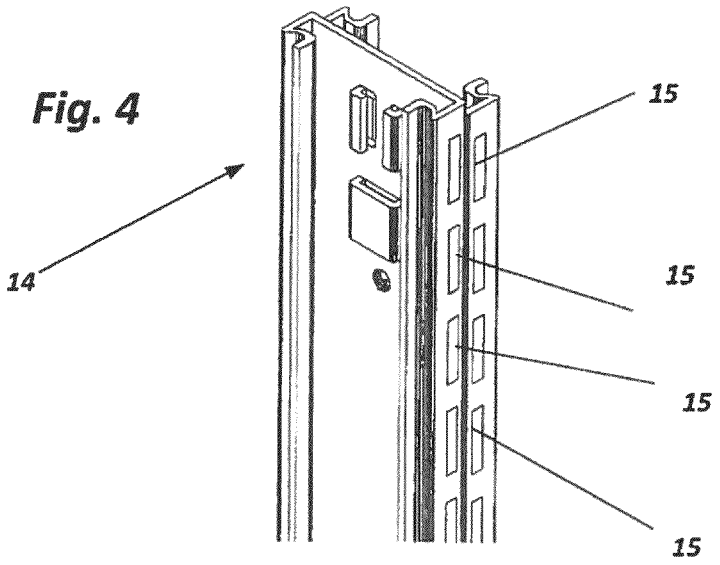
FIG. 4 is a partial perspective view of a vertical post of the frame of a gondola-style shelving unit.

FIG. 4 shows one of the upright vertical posts 14 of the frame. The upright vertical posts have a plurality of slots 15 which are typically arranged in a single row or in two rows as illustrated on one or more sides (or walls) of the upright vertical posts 14.

Figure 5:
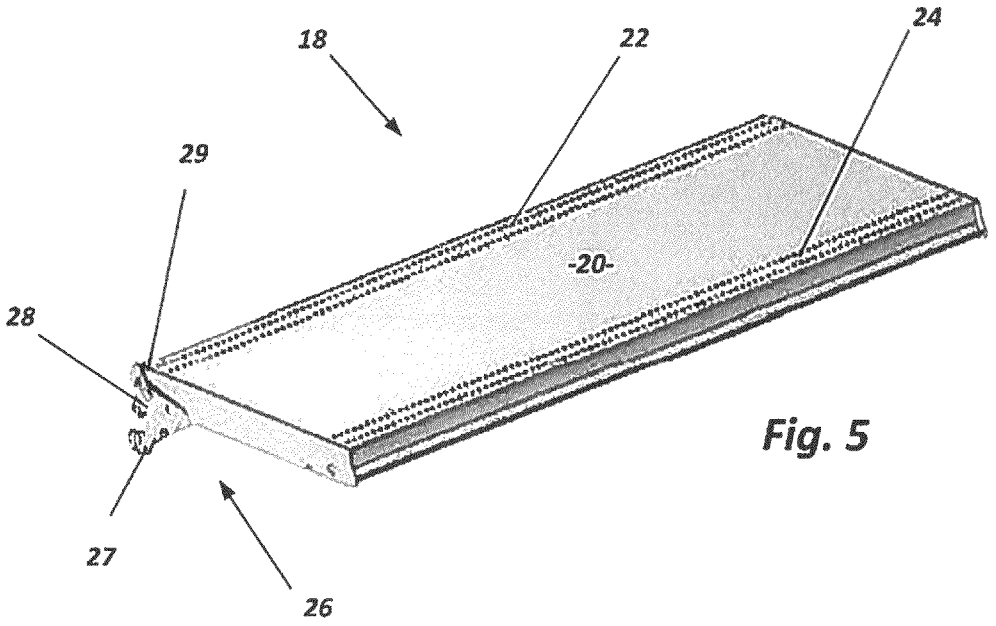
FIG. 5 is a perspective view of a shelf used as part of a gondola-style shelving system.

FIG. 5 shows a standard gondola-style shelf 18. The gondola-style shelf includes a flat support deck 20. Extending along the back of the deck 20 are rows of perforations 22. Similarly, rows of perforations 24 extend along the front of the shelving. These perforations or holes are typically used to secure fencing or dividers to the shelves. Attached to each end of the deck 20 is an end bracket 26. The end bracket 26 includes three hooks 27, 28 and 29 which mate with three adjacent slots 15 in the posts 14 to secure the shelves 18 to the frame 10. The arrangement of the brackets 26 and slots 15 in the upright posts 14 permit the height of the shelves to be adjusted.

Figure 6:
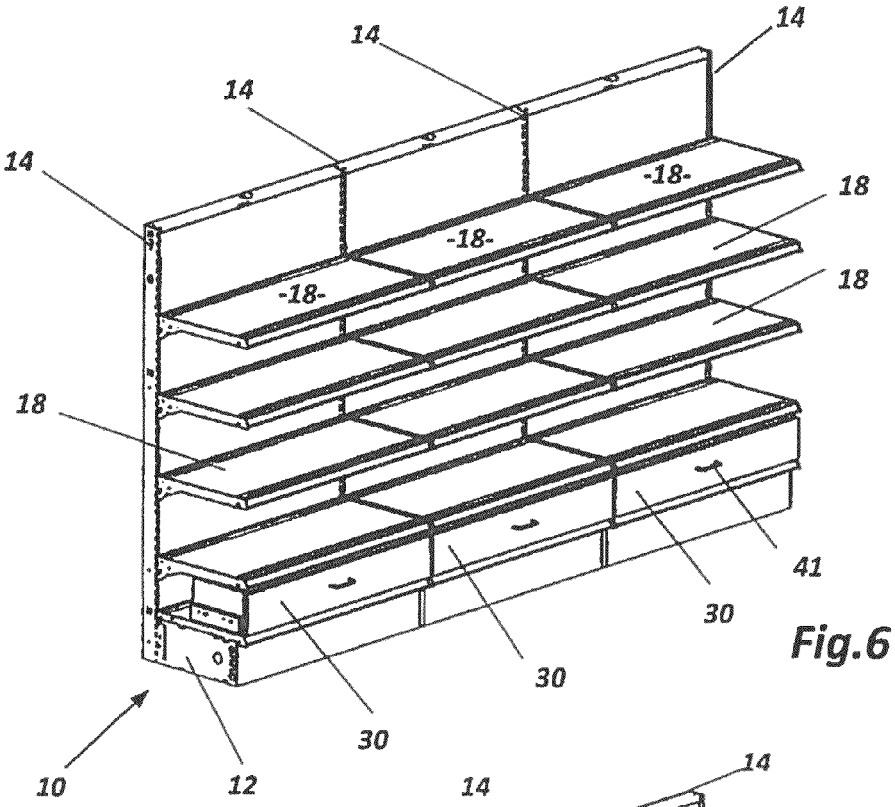
FIG. 6 is a perspective view of a gondola-style shelving system having a plurality of drawers arranged adjacent to each other horizontally.
Figure 7:
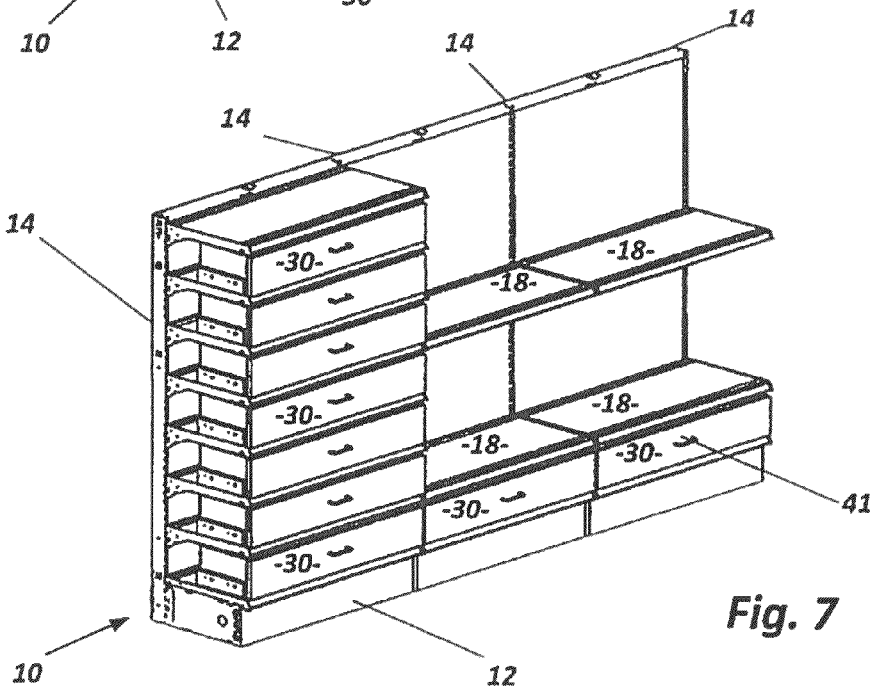
FIG. 7 is a perspective view of a gondola-style shelving unit having a plurality of drawers arranged horizontally and vertically.

FIGS. 6 and 7 each show a gondola-style shelving unit having a frame 10 such as that shown in FIG. 3 which includes a base 12 and upright vertical posts 14. Also shown in FIGS. 6 and 7 are a plurality of shelves 18. In FIG. 6, three drawers 30 are aligned horizontally across the bottom of the gondola-style shelving unit. FIG. 7 includes three drawers 30 arranged horizontally as well as a stack of vertically arranged drawers 30.

Figure 8:
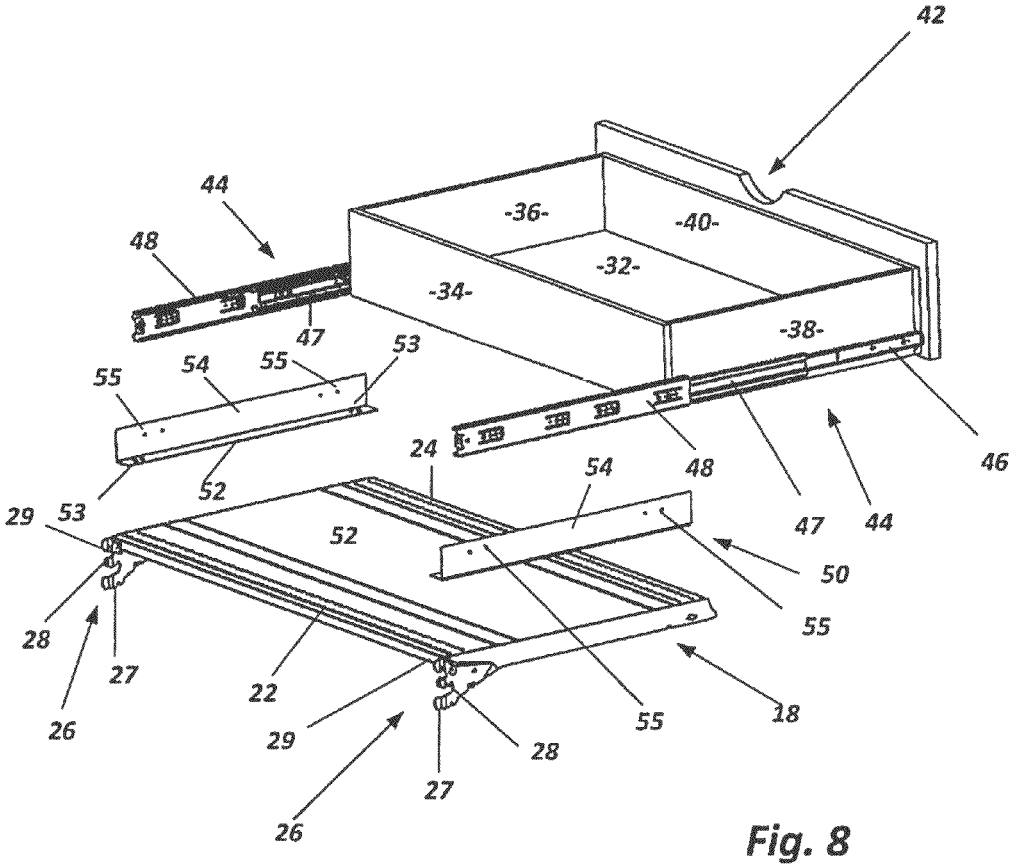
FIG. 8 is an exploded view of one of the drawers shown in FIGS. 6 and 7.

FIG. 8 shows the manner in which the drawers 30 may be attached to the shelves 18 for further attachment to the vertical support posts 14 of the frame 10 at a desired height and location of the gondola-style shelving unit. As illustrated in FIG. 8, each drawer 30 includes a bottom 32, a back wall 34, side walls 36 and 38 and a front wall 40. The drawer may include a separate handle, 41 secured to the front of the drawer in a standard fashion as illustrated in FIGS. 6 and 7. Alternatively, a handle 42 may be formed into the front of the drawer as illustrated in FIG. 8.

Attached to each side 36 and 38 of the drawer 30 is an assembly for mounting a drawer 30 to the shelf 18. Each such assembly includes a telescoping bracket 44 and an L-shaped mounting bracket 50. The telescoping bracket 44 includes three telescoping members 46, 47 and 48. Telescoping member 46 is attached to a side 36 or 38 of the drawer using screws or some other suitable fastener so that it is fixed with respect to the drawer 30. Each L-shaped mounting bracket 50 includes a first plate member 52 and a second plate member 54 extending from the first plate member at approximately a right angle. The first plate member 52 of each of the mounting brackets 50 is attached to the shelf 18 using nuts and bolts which extend through holes 53 at opposing ends of plate member 52 and through a perforation in one of the rows 22 and a perforation in one of the rows 24 to secure the L-shaped mounting brackets 50 to the shelf 18. The spacing between the mounting brackets 50 may easily be adjusted by selecting which of the perforations in the row of perforations to use to attach a particular mounting mounting bracket 50 to the shelf 18. The distance between the mounting brackets 50 is selected to permit the mounting brackets 50 to then be attached to members 48 of the telescoping brackets 44. This attachment is again achieved by passing a bolt or other suitable fastener through holes 55 in the plate 54 of mounting bracket 50 aligned with holes 49 in the members 48 of telescoping bracket 44. Upon completion of this assembly, the drawer 30 and shelf 18 can be joined to the frame 10 at a desired location by inserting the hooks 27-29 of the end brackets 26 of the shelf 18 into the slots 15 of adjacent posts 14 of the frame of the gondola-style shelving unit.

Figures 9, 10, 11:
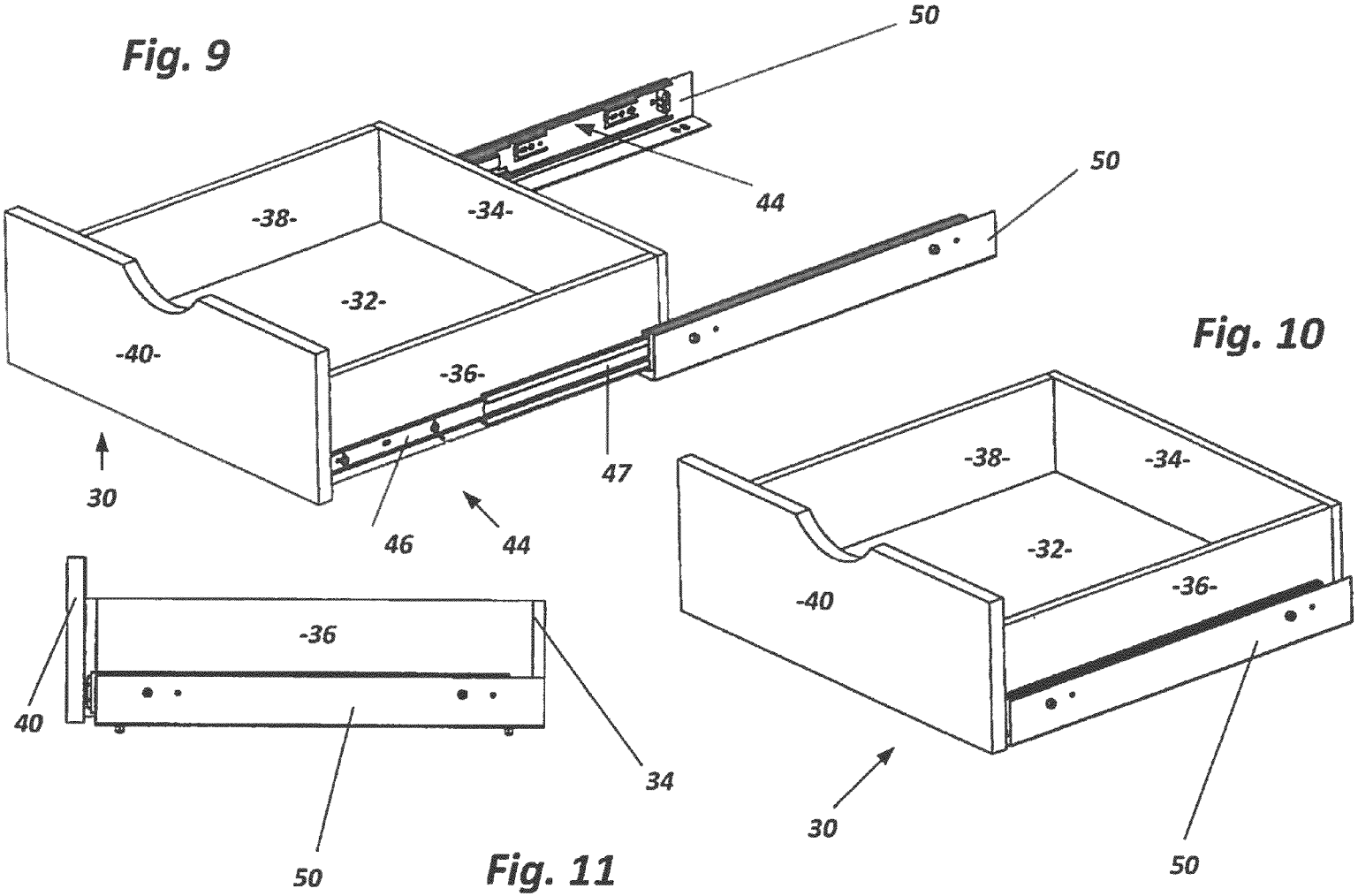
FIG. 9 shows the drawer of FIG. 8 fully assembled in its extended, open position.
FIG. 10 is a perspective view of the drawer of FIG. 9 in its closed position.
FIG. 11 is a side view of the drawer of FIG. 9 in its closed position.

FIGS. 9-11 show the drawer assembly prior to attachment to the shelf 18. As shown, the drawer assembly includes drawer 30 having a front panel 40 and an integrally formed handle 42, side panels 36 and 38, a drawer bottom 32 and a back panel 34. The drawer assembly also includes the telescoping brackets 44 and the L-shaped brackets 50. In FIG. 9, the drawer is shown in its open, extended position. In FIGS. 10 and 11, the drawer is shown in its closed position.

Figure 12:
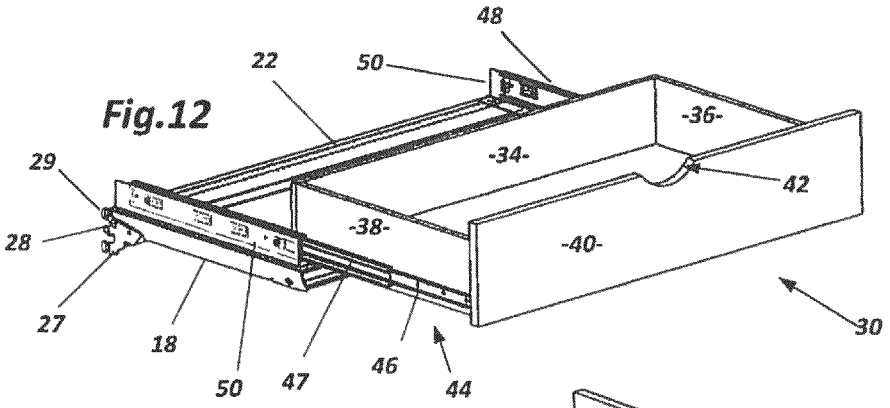
FIG. 12 is a perspective view of the drawer of FIG. 11 attached to a standard gondola-style shelf in its open position.
Figure 13:
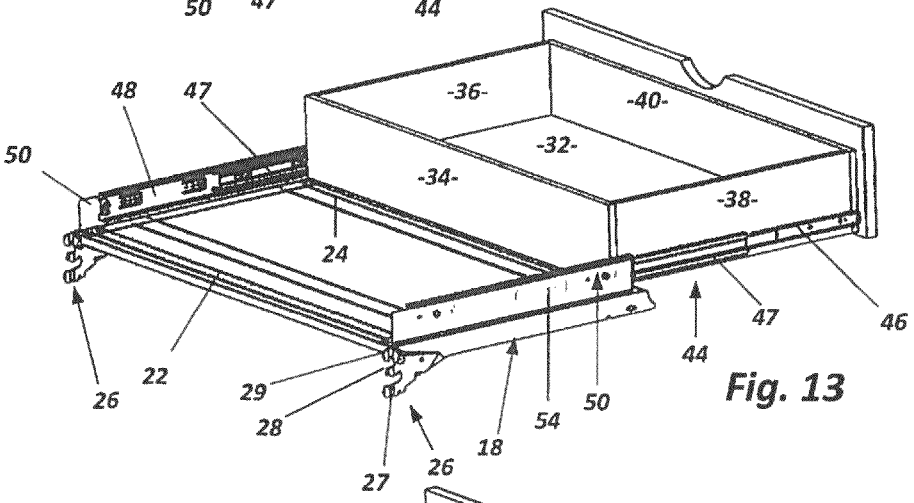
FIG. 13 is an alternative perspective view of the drawer and shelf shown in FIG. 12.
Figure 14:
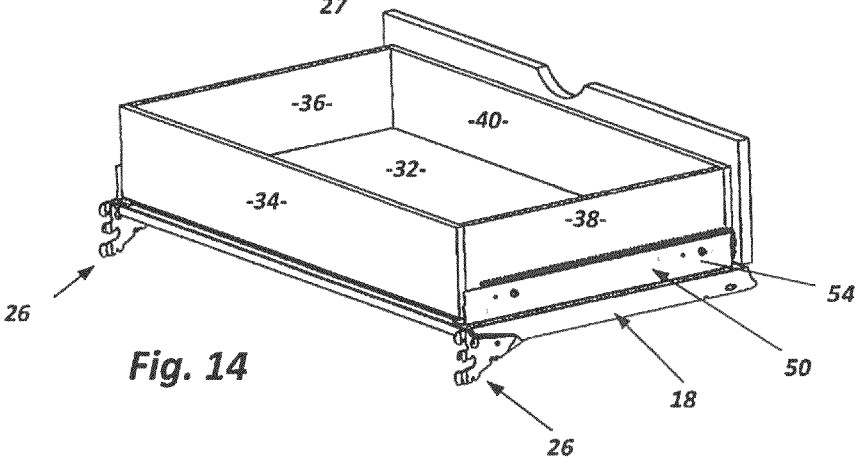
FIG. 14 is a perspective view of the arrangement shown in FIGS. 12 and 13, but with the drawer in its closed position.

FIGS. 12-14 show the drawer assembly attached to a shelf 18. The entire assembly includes the drawer 30, the telescoping brackets 44 comprising members 46, 47 and 48, the L-shaped mounting bracket 50, the fasteners used to attach the members 46 of the telescoping brackets 44 to the sides 36 and 38 of drawer 30, the shelf 18, and the fasteners used to secure the L-shaped mounting brackets 50 to members 48 of the telescoping brackets 44 and to the shelf 18.

Figure 15:
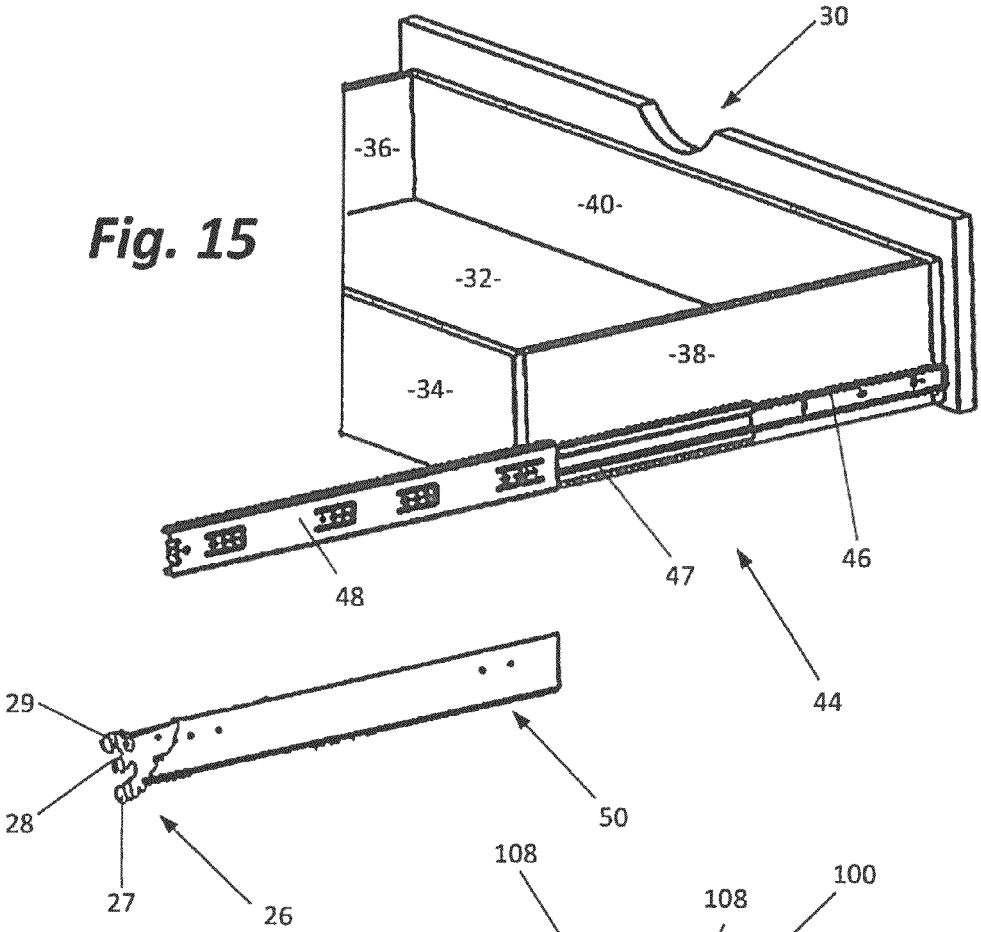
FIG. 15 is an exploded view of an alternative embodiment.

FIG. 15 illustrates an alternative to the embodiment of FIGS. 8-14. The embodiment of FIG. 15 also includes a drawer 30 and mounting assembly including telescoping brackets 44 and mounting brackets 50. However, the mounting brackets 50 of FIG. 15 permit the mounting assemblies to be coupled directly to the posts 14 of the frame of the gondola-type shelving unit. This arrangement of FIG. 15 does enable the shelf 18 to be eliminated from the assembly, but requires the drawer width to be approximately the same as the distance between the two adjacent posts 14 to which the drawer 30 is attached. The embodiment of FIGS. 8-14 permits narrower drawers to be employed.

More specifically, in the arrangement of 15 two mounting assemblies are provided as is the case with the embodiment of FIGS. 8-14. Each side 36 and 38 of the drawer is coupled to one of the mounting assemblies. As shown FIG. 15, each mounting assembly includes a telescoping bracket 44 comprising members 46, 47 and 48. Member 46 is shown fixed to the side, 38 of drawer 30. The member 46 of the other telescoping bracket member 44 (not shown) is attached to side 36 of the drawer 30. Each mounting assembly also includes a mounting bracket 50 which includes a plate and an end bracket 26 of the type typically found on gondola-style shelves such as the shelves 18. The end bracket includes hooks 27, 28 and 29 and is used to couple the mounting bracket 50 to the posts 14 of the gondola shelving unit frame. The plate of mounting bracket 50 is fastened using suitable fasteners to the member 48 of telescoping bracket 44. When the drawer 30 and attached mounting assemblies are coupled to adjacent vertical posts 14, the drawer 30 is supported and can be pulled out to an open position and pushed in to a closed position via action of the telescoping members 46, 47 and 48 of the telescoping bracket 44. Cross members, not shown, may extend between the mounting brackets 50 to make the mounting assembly more rigid.

Figure 16:
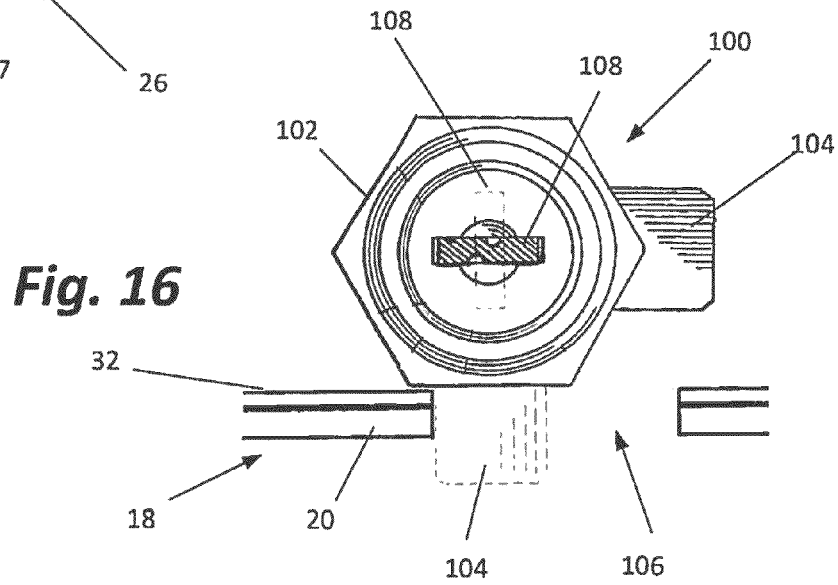
FIG. 16 illustrates a lock which may be employed to lock the drawer in the closed position.

In certain settings, it may be advantageous to be able to lock the drawers 30 in the closed position. This can be achieved in any one of a number of ways. In the embodiment of FIGS. 8-14, the lock may be as illustrated in FIG. 16. As shown, the lock 100 included a lock cylinder 102 and a latch 104 mounted to the cylinder 102 for rotation by the lock cylinder 102 between an unlocked position shown in solid lines and a locked position shown in broken lines. Rotation is achieved by inserting and turning a key 108. The lock 100 is ideally suited for mounting near the bottom of the front 40 of drawer 30. An opening 106 is provided through the bottom 32 of drawer 30 and through the deck 20 of the shelf 18. Rotation of the latch 104 toward the locked position causes latch 104 to enter the opening 106. Surfaces defining the opening 106 surround the it 104 thereby preventing the door from opening when the latch 104 is in the locked position. The door 30 can be opened as soon as the latch 104 is rotated out of the hole 106 by turning key 108.

From the foregoing, it will be appreciated that all specific examples have been described herein for purposes of illustration and various modifications may be made without deviating from the spirit and scope of this disclosure. By way of further example, the front of the drawer may be made of a transparent material so that the contents of the drawer may be viewed through the front of the drawer. Likewise, the drawer may be fitted with a key lock, combination lock or an electronic lock. The lock may be mounted to the front of the drawer and operated by a key which moves a latch which extends through the bottom of the drawer 32 and into and through a hole in the shelf 18 as illustrated in FIG. 16. Alternatively, the lock may be mounted to the shelf 18 or mounting bracket 50 and have a latch which engages a structure of the door or telescoping bracket 44 to lock the door in the closed position. It is, therefore, intended that the foregoing detailed description be regarded as illustrative rather than limiting, and that it be understood that it is the following claims, including all equivalents, that are intended to identify the invention.

What is claimed is:

1. A drawer assembly comprising:

(a) a gondola style shelving system frame comprising a base and first and second upright vertical posts each of said upright vertical posts having a plurality of slots;

(b) a drawer having a bottom wall, a front wall, first and second side walls and a back wall; and (c) first and second drawer mounting assemblies affixed individually and directly to the first and second side walls, said first and second drawer mounting assemblies each including (i) a telescoping bracket having a first member fastened directly to a respective one of the first and second side walls and a second member, and (ii) a mounting bracket having a leg in face-to-face registration with and coupled to the second member of an associated telescoping bracket, and (iii) an end bracket coupled to the mounting bracket, said end bracket comprising a plurality of hooks adapted to be received within and secured to selected slots of the plurality of slots of one of the upright vertical posts such that the drawer extends forward from the first and second upright vertical posts at a selected vertical height and is supported exclusively by the base, the first and second upright vertical supports and the first and second drawer mounting assemblies; and wherein the end brackets of the first and second assemblies are coupled to the mounting brackets of the first and second assemblies via a shelf to which said end brackets and said mounting brackets are attached.

2. The drawer assembly of claim 1 further including a drawer handle on the front wall.

3. The drawer assembly of claim 1 further comprising a lock having a locked condition which prevents the drawer from being opened and an unlocked condition which allows the drawer to be opened.

4. The drawer assembly of claim 1 wherein the front wall is made of a transparent material.

5. The drawer assembly of claim 1 wherein the end bracket is coupled directly to the mounting bracket.

6. The drawer assembly of claim 1 wherein the end bracket is integrally formed with the mounting bracket.

7. A drawer assembly comprising:

(a) gondola style shelving system frame comprising a plurality of upright vertical posts, each of said upright vertical posts having a plurality of slots;

(b) a drawer having a bottom wall, a front wall, first and second side walls and a back wall; and (c) first and second assemblies located on opposite sides of the drawer for mounting the drawer, the first assembly for mounting the drawer including a first telescoping bracket having a first member fastened directly to the first side wall of the drawer and a second member, and (ii) a first mounting bracket having an end bracket comprising a plurality of hooks adapted to be received within the slots of and secured to a first of said plurality of vertical supports and a leg in face-to-face registration with and coupled to the second member of the first telescoping bracket, and the second, assembly for mounting the drawer including (i) a second telescoping bracket having a first member fastened directly to the second side wall of the drawer and a second member, and (ii) a second mounting bracket having an end bracket comprising a plurality of hooks adapted to be received within the slots and secured to a secondly said plurality of vertical supports and a leg in face-to-face registration with and coupled to the second member of the second telescoping bracket, wherein said drawer extends forward from the first and second vertical supports and is supported exclusively by the base, the first and second upright vertical supports and the first and second assemblies; wherein the end brackets of the first and second assemblies are coupled to the mounting brackets of the first and second assemblies via a shelf to which said end brackets and said mounting brackets are attached.

8. The drawer assembly of claim 7 further including a drawer handle on the front wall.

9. The drawer assembly of claim 7 further comprising a lock actuated by a key between a locked condition which prevents the drawer from being opened and an unlocked condition which allows the drawer to be opened.

10. The drawer assembly of claim 7 wherein the front wall is made of a transparent material.

* * * * *